US008600260B2

(12) United States Patent
Fujiwara

(10) Patent No.: US 8,600,260 B2
(45) Date of Patent: Dec. 3, 2013

(54) IMAGE FORMING DEVICE INCLUDING SHEET-METAL HOUSING

(75) Inventor: Daisuke Fujiwara, Osaka (JP)

(73) Assignee: Kyocera Mita Corporation (JP)

( * ) Notice: Subject to any disclaimer, the term of this patent is extended or adjusted under 35 U.S.C. 154(b) by 219 days.

(21) Appl. No.: 13/153,527

(22) Filed: Jun. 6, 2011

(65) Prior Publication Data

US 2011/0299871 A1 Dec. 8, 2011

(30) Foreign Application Priority Data

Jun. 7, 2010 (JP) ..... 2010-129913

(51) Int. Cl.
*G03G 15/00* (2006.01)

(52) U.S. Cl.
USPC ..... 399/90; 399/88

(58) Field of Classification Search
USPC ..... 399/90, 107
See application file for complete search history.

(56) References Cited

U.S. PATENT DOCUMENTS 5,201,854 A * 4/1993 Ahl et al. ..... 439/247
6,975,814 B2 * 12/2005 Tsusaka et al. ..... 399/6
7,664,425 B2 * 2/2010 Tsusaka ..... 399/107
7,831,168 B2 * 11/2010 Allen et al. ..... 399/90
2006/0079358 A1 * 4/2006 Igarashi ..... 474/87
2007/0230988 A1 * 10/2007 Nobe et al. ..... 399/88
2010/0014887 A1 * 1/2010 Tomatsu et al. ..... 399/107
2010/0239304 A1 * 9/2010 Sato et al. ..... 399/90
2011/0116824 A1 * 5/2011 Shirai et al. ..... 399/90
2011/0262173 A1 * 10/2011 Souda ..... 399/89

FOREIGN PATENT DOCUMENTS

JP 2009-15126 1/2009
JP 2010-8670 1/2010

* cited by examiner

*Primary Examiner* — David Gray
*Assistant Examiner* — Tyler Hardman
(74) *Attorney, Agent, or Firm* — Gerald E. Hespos; Michael J. Porco; Matthew T. Hespos

(57) ABSTRACT

An image forming device includes: a processing unit that performs an image forming process on a sheet; a housing that defines a housing space in which the processing unit is housed; a high-voltage board that generates a high voltage to be supplied to the processing unit; a wire that electrically connects the high-voltage board and the processing unit with each other; and a wire holding plate that holds the wire. The housing includes a pair of a first sheet-metal frame and a second sheet-metal frame which oppose each other and a sheet-metal coupling piece which couples these sheet-metal frames, and the first sheet-metal frame and the second sheet-metal frame support the processing unit between the first sheet-metal frame and the second sheet-metal frame. The wire holding plate extends over substantially the entire dimension of the coupling piece in an extending direction thereof and is fixed to the coupling piece.

8 Claims, 12 Drawing Sheets

IMAGE FORMING DEVICE INCLUDING SHEET-METAL HOUSING

BACKGROUND OF THE INVENTION

1. Field of the Invention.

The present invention relates to an image forming device having a processing unit which performs an image forming process on a sheet of paper and a sheet-metal housing which houses the processing unit.

2. Description of the Related Art.

Electrophotographic image forming devices such as a printer and a facsimile have a plurality of built-in processing units for performing an image forming process on a sheet of paper. Examples of processing units include a photosensitive drum unit on which a toner image is formed, a developing unit which supplies toner to a photosensitive drum in order to form a toner image on the photosensitive drum and, in a case of a tandem-type image forming device, an intermediate transfer unit having an intermediate transfer belt onto which a color toner image is transferred.

An image forming device further includes a housing which defines a housing space that houses a plurality of processing units such as those described above and which supports the processing units inside the housing space. Normally, the housing is constituted by a sheet-metal frame member in order to secure rigidity of the housing.

Meanwhile, recent image forming devices are required to be lighter while securing rigidity of housings. When a housing constituted by a sheet-metal frame member such as described above is used, although the rigidity of the housing can be secured, achieving a lighter weight of the image forming device may prove difficult. Therefore, the afore-mentioned requirement toward recent image forming devices cannot be satisfied.

SUMMARY OF THE INVENTION

An object of the present invention is to provide an image forming device capable of achieving lighter weight while securing rigidity.

An image forming device according to an aspect of the present invention which achieves this object includes: a processing unit which performs an image forming process on a sheet; a housing which defines a housing space that houses the processing unit, and which includes a pair of a first sheet-metal frame and a second sheet-metal frame that oppose each other and a sheet-metal coupling piece extending between the first sheet-metal frame and the second sheet-metal frame and coupling the first sheet-metal frame and the second sheet-metal frame to each other, with the first sheet-metal frame and the second sheet-metal frame being configured to support the processing unit therebetween; a high-voltage board which generates a high voltage to be supplied to the processing unit; a wire which electrically connects the high-voltage board and the processing unit with each other and which supplies the high voltage to the processing unit; and a wire holding plate which holds the wire, and which extends over substantially the entire dimension of the coupling piece in an extending direction thereof and is fixed to the coupling piece.

DETAILED DESCRIPTION OF THE PREFERRED EMBODIMENTS

Figure 1:
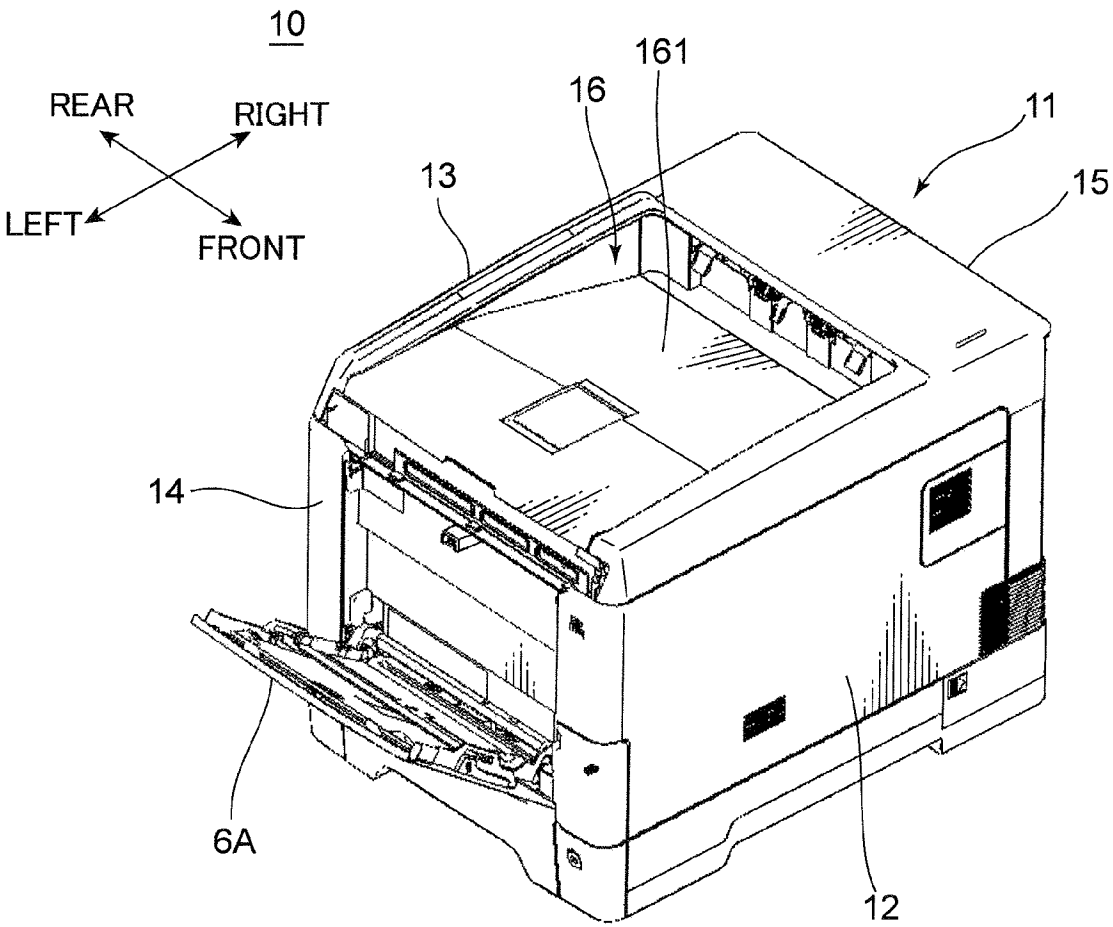
FIG. 1 is an external perspective view of an image forming device according to an embodiment of the present invention.

Embodiments according to the present invention will now be described with reference to the drawings. FIG. 1 is an external perspective view of an image forming device 10 according to an embodiment of the present invention. The image forming device 10 is, for example, a tandem-type color printer and includes a box-shaped housing 11. The housing 11 includes a front cover 12 that covers the front, a rear cover 13 that covers the rear, a right side cover 15 that covers the right side, and a left side cover 14 that covers the left side. The covers 12, 13, 14, and 15 constitute an outer cover that defines an external design of the image forming device.

A sheet discharge section 16 from which sheets are discharged is provided on an upper part of the housing 11. A sheet discharge surface 161 to which a sheet with a formed image is discharged is formed at the sheet discharge section 16. In addition, a manual feed tray 6A is provided on the left side cover 14 so as to be openable and closeable. The manual feed tray 6A is also used as a part of the outer cover that determines the external design of the image forming device. It should be noted that terms indicating directions such as "up", "down", "left", "right", "front", and "rear" are merely used to clarify description and are not intended to limit the present invention in any way.

Figure 2:
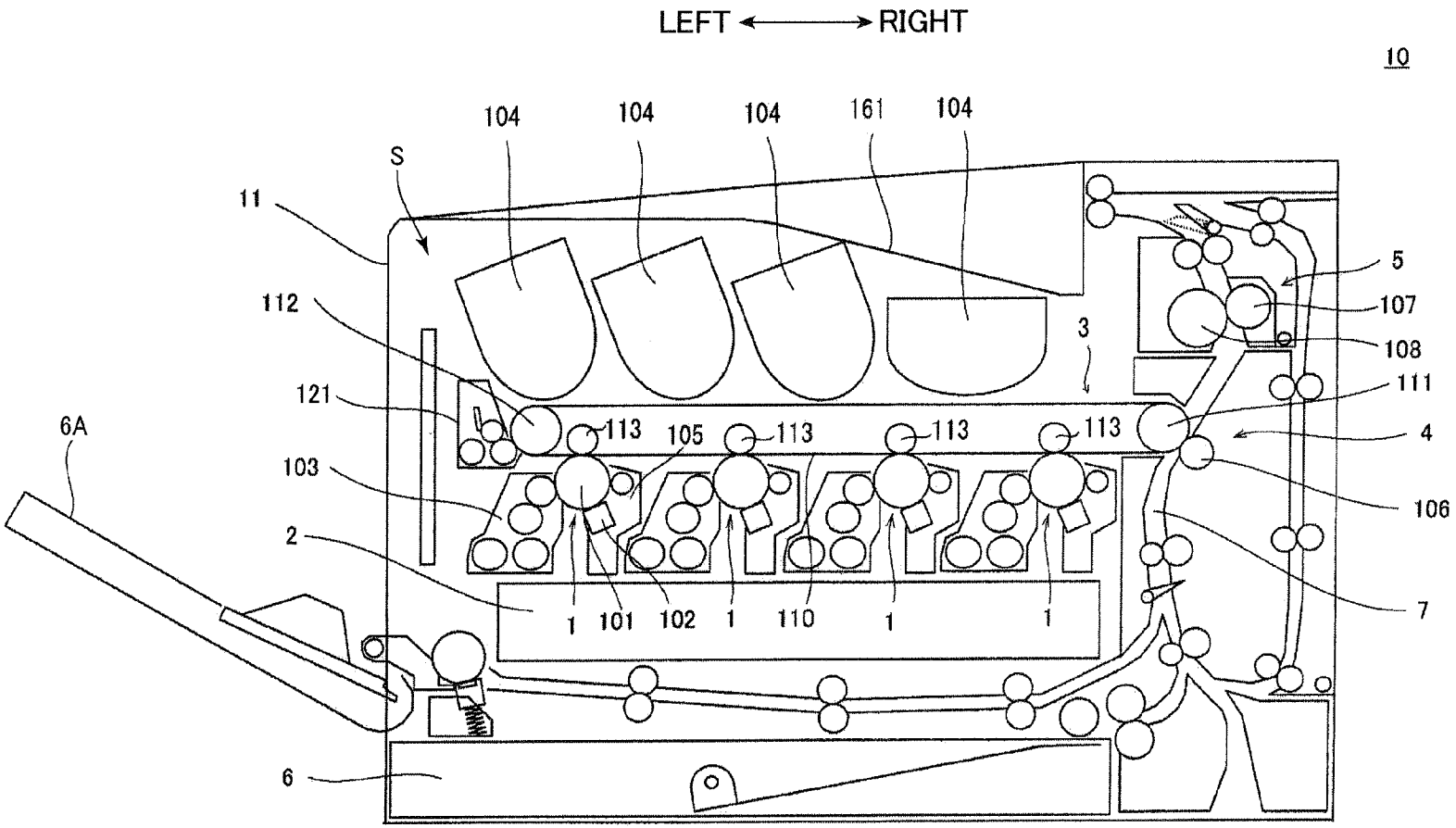
FIG. 2 is a side cross-sectional view showing an internal structure of the image forming device.

FIG. 2 is a side cross-sectional view showing an internal structure of the image forming device 10. The housing 11 internally includes a plurality of processing units that perform an image forming process on a sheet. In the present embodiment, processing units include: an image forming unit 1 that forms a toner image in each color on a photosensitive drum 101 based on image information transmitted from an external device such as a computer; an optical scanning unit 2 that forms an electrostatic latent image on a circumferential surface of the photosensitive drum 101; an intermediate transfer unit 3 that performs a primary transfer of a toner image formed on the photosensitive drum 101; a secondary transfer unit 4 that transfers a toner image of the intermediate transfer unit 3 onto a sheet; and a fixing unit 5 that applies a fixing process to a toner image transferred onto a sheet. In addition, the housing 11 is internally provided with a paper feeding cassette 6 that stacks and houses sheets onto which a toner image is to be transferred, and a conveying path 7 that conveys sheets from the paper feeding cassette 6 or the manual feed tray 6A described earlier.

Four image forming units 1 are arranged at predetermined intervals in a horizontal direction in order to form toner images in respective colors of black, magenta, cyan, and yellow. Each image forming unit 1 includes: a photosensitive drum 101 that bears an electrostatic latent image; a charger 102 that charges a circumferential surface of the photosensitive drum 101; a developing device 103 that transfers a developer onto an electrostatic latent image to forma toner image; respective toner containers 104 of black, magenta, cyan, and yellow that supply a toner of a predetermined color to the developing device 103; and a cleaning device 105 that removes residual toner on the circumferential surface of the photosensitive drum 101.

The intermediate transfer unit 3 includes: a transfer belt 110 that revolves while contacting a circumferential surface of each photosensitive drum 101; a driving roller 111 and a driven roller 112 between which a transfer belt 110 is suspended; and a primary transfer roller 113 that presses the transfer belt 110 against each photosensitive drum 101. A toner image on the photosensitive drum 101 is primary-transferred onto the transfer belt 110, and a toner image on the transfer belt 110 is secondary-transferred onto a sheet by a secondary transfer roller 106 of the secondary transfer unit 4 arranged so as to oppose the driving roller 111. Toner not transferred onto the sheet and remaining on the circumferential surface of the transfer belt 110 is collected by a belt cleaning device 121 arranged so as to oppose the driven roller 112.

The fixing unit 5 includes a pair of fixing rollers 107 and 108, and while passing a sheet on which a toner image has been transferred between the fixing rollers 107 and 108, fixes the toner image onto the sheet by heating. The sheet subjected to the fixing process is discharged onto the sheet discharge surface 161.

Figure 3:
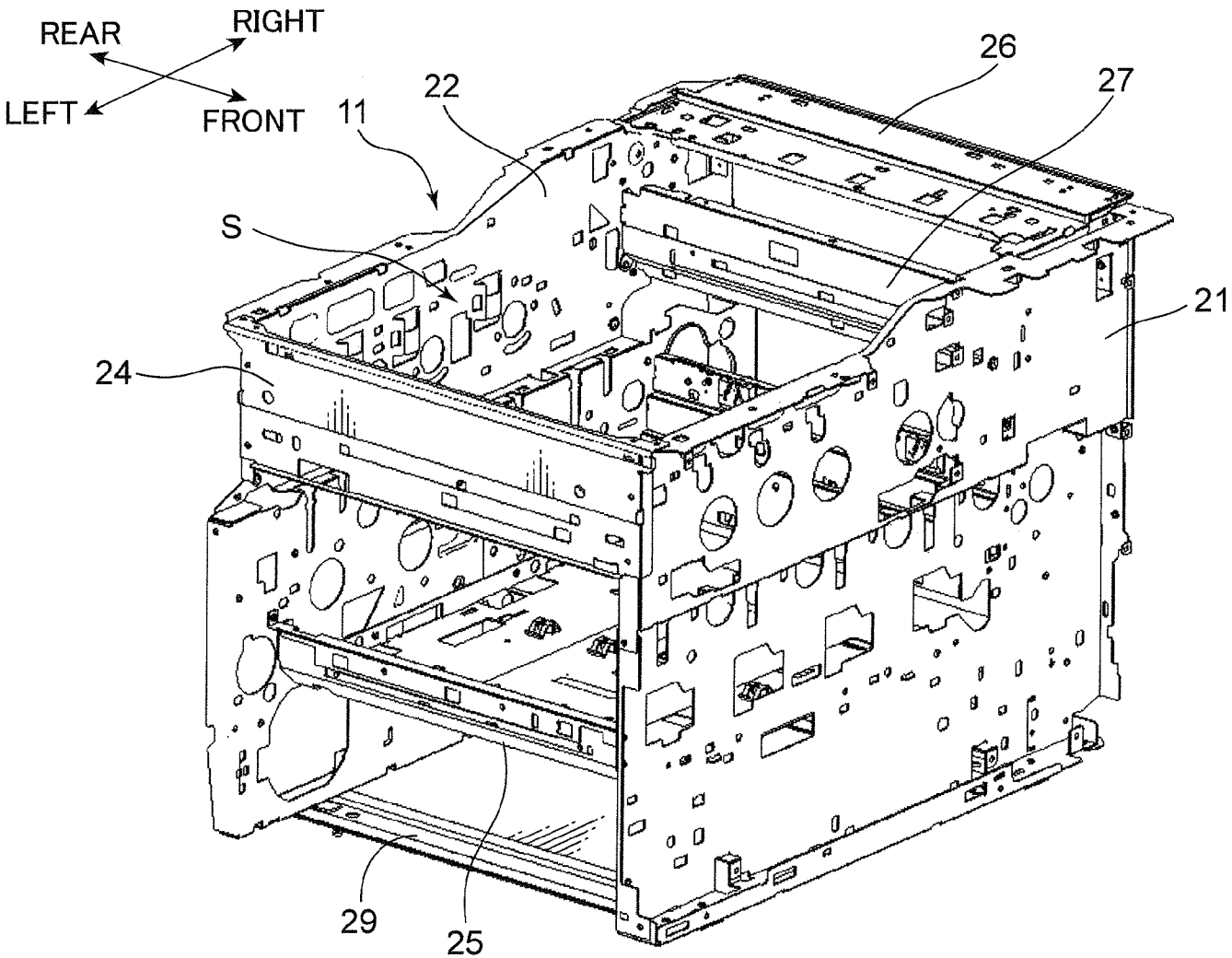
FIG. 3 is a perspective view showing a frame structure of a housing in a state where an external cover and peripheral parts have been removed from the housing.

FIG. 3 is a perspective view showing a frame structure of the housing 11 in a state where an external cover and peripheral parts have been removed from the housing 11. The housing 11 includes a frame member that defines a housing space S for housing processing units such as those described above. The frame member is made of sheet metal and has a first sheet-metal frame 21 corresponding to the front of the housing 11 and a second sheet-metal frame 22 corresponding to the rear of the housing 11. The first sheet-metal frame 21 and the second sheet-metal frame 22 constitute a pair that opposes each other in a front-rear direction of the housing 11. The processing units are supported in the housing space S between the first and second sheet-metal frames 21 and 22.

The frame member further has a plurality of sheet-metal coupling pieces that couple the first sheet-metal frame 21 and the second sheet-metal frame 22 in the front-rear direction of the housing 11. In the present embodiment, coupling pieces include an upper coupling piece 24 (first coupling piece), a lower coupling piece 25 (second coupling piece), and a bottom coupling piece 29. The upper coupling piece 24 extends between an upper part of a left edge (one edge) of the first sheet-metal frame 21 and an upper part of a left edge of the second sheet-metal frame 22, and couples the first sheet-metal frame 21 and the second sheet-metal frame 22 with each other. The lower coupling piece 25 is separated by a predetermined distance from the upper coupling piece 24 and positioned below the upper coupling piece 24, and extends between an approximately middle part of the left edge of the first sheet-metal frame 21 and an approximately middle part of the left edge of the second sheet-metal frame 22 and couples the first sheet-metal frame 21 and the second sheet-metal frame 22 with each other. The bottom coupling piece 29 extends between a lower edge of the first sheet-metal frame 21 and a lower edge of the second sheet-metal frame 22 on the side of the left side of the housing 11, and couples the first sheet-metal frame 21 and the second sheet-metal frame 22 with each other.

Since the upper coupling piece 24 and the lower coupling piece 25 are separated from each other by a predetermined distance, a space is formed between the upper coupling piece 24 and the lower coupling piece 25. In addition, the upper coupling piece 24 and the lower coupling piece 25 are fixed at an angle of 90 degrees with respect to a direction in which the first sheet-metal frame 21 extends, and the upper coupling piece 24 and the lower coupling piece 25 are also fixed at an angle of 90 degrees with respect to a direction in which the second sheet-metal frame 22 extends. Furthermore, the bottom coupling piece 29 is separated by a predetermined distance from the lower coupling piece 25 and positioned below the lower coupling piece 25, and a space is formed between the bottom coupling piece 29 and the lower coupling piece 25.

In addition, in the present embodiment, coupling pieces further include a coupling piece 26 that couples an upper edge of the first sheet-metal frame 21 and an upper edge of the second sheet-metal frame 22 with each other on the side of the right side of the housing 11, and a coupling piece 27 that couples the first sheet-metal frame 21 and the second sheet-metal frame 22 with each other at a position below the coupling piece 26.

Figure 4:
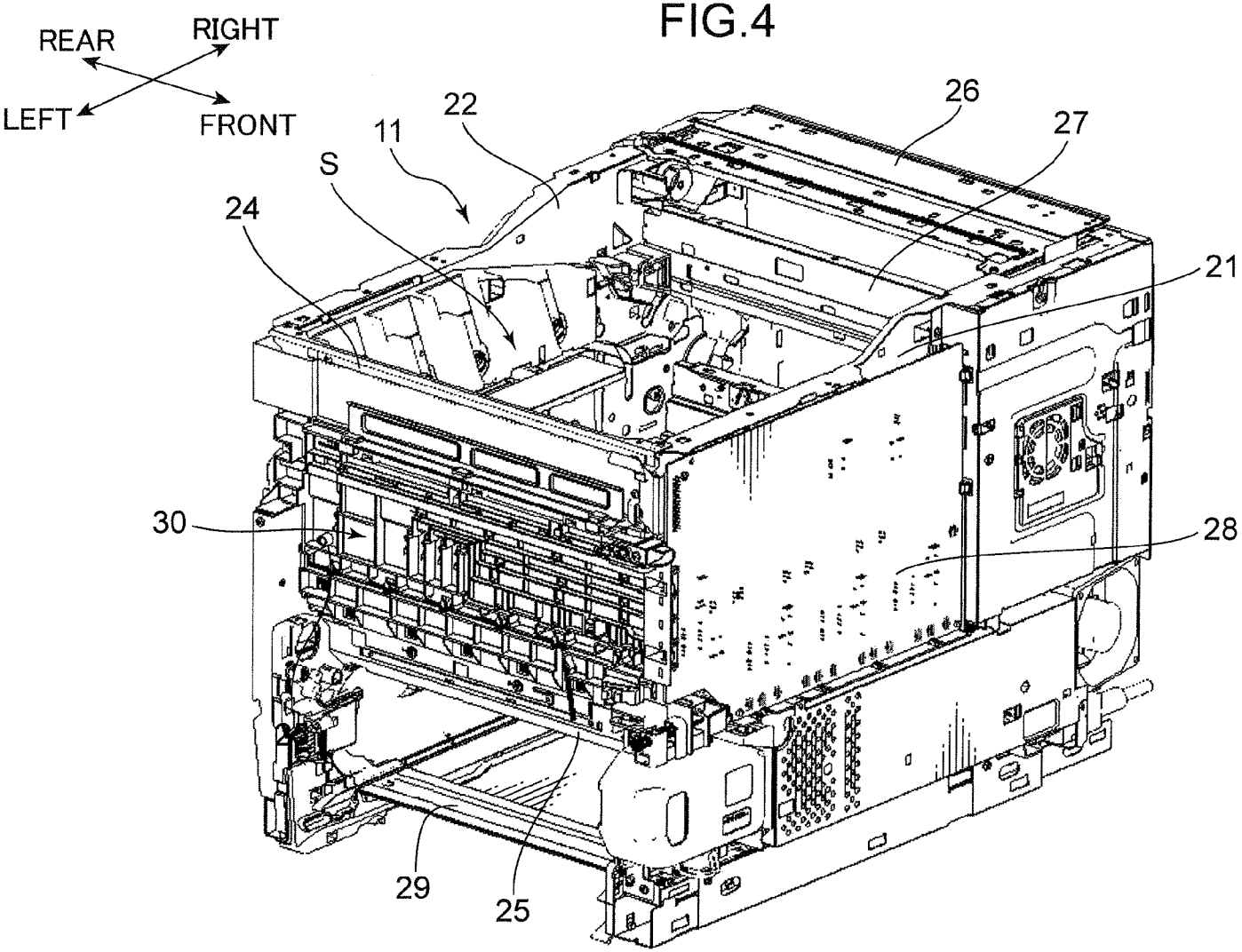
FIG. 4 is a perspective view showing the housing in a state where peripheral parts are attached to a frame member of the housing.

FIG. 4 is a perspective view showing the housing 11 in a state where peripheral parts are attached to the frame member of the housing 11. Various peripheral parts are attached to the frame member. For example, a high-voltage board 28 for supplying a high voltage to the processing units housed in the housing 11 is fixed to an external surface of the first sheet-metal frame 21. In addition, a wire holding plate 30 is fixed to an external surface of the upper coupling piece 24 and an external surface of the lower coupling piece 25.

Figure 5:
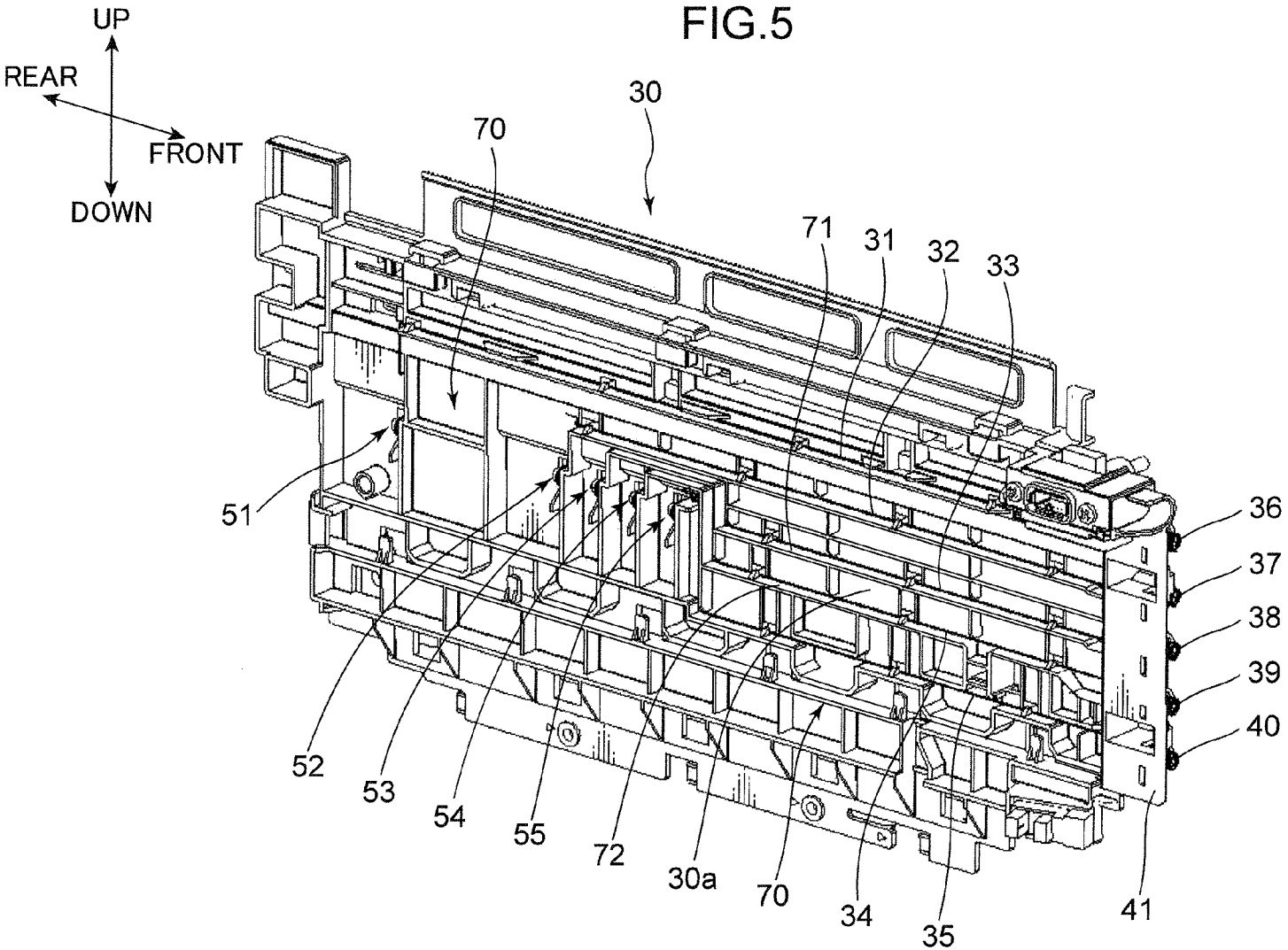
FIG. 5 is a perspective view of a wire holding plate as seen from the front.
Figure 6:
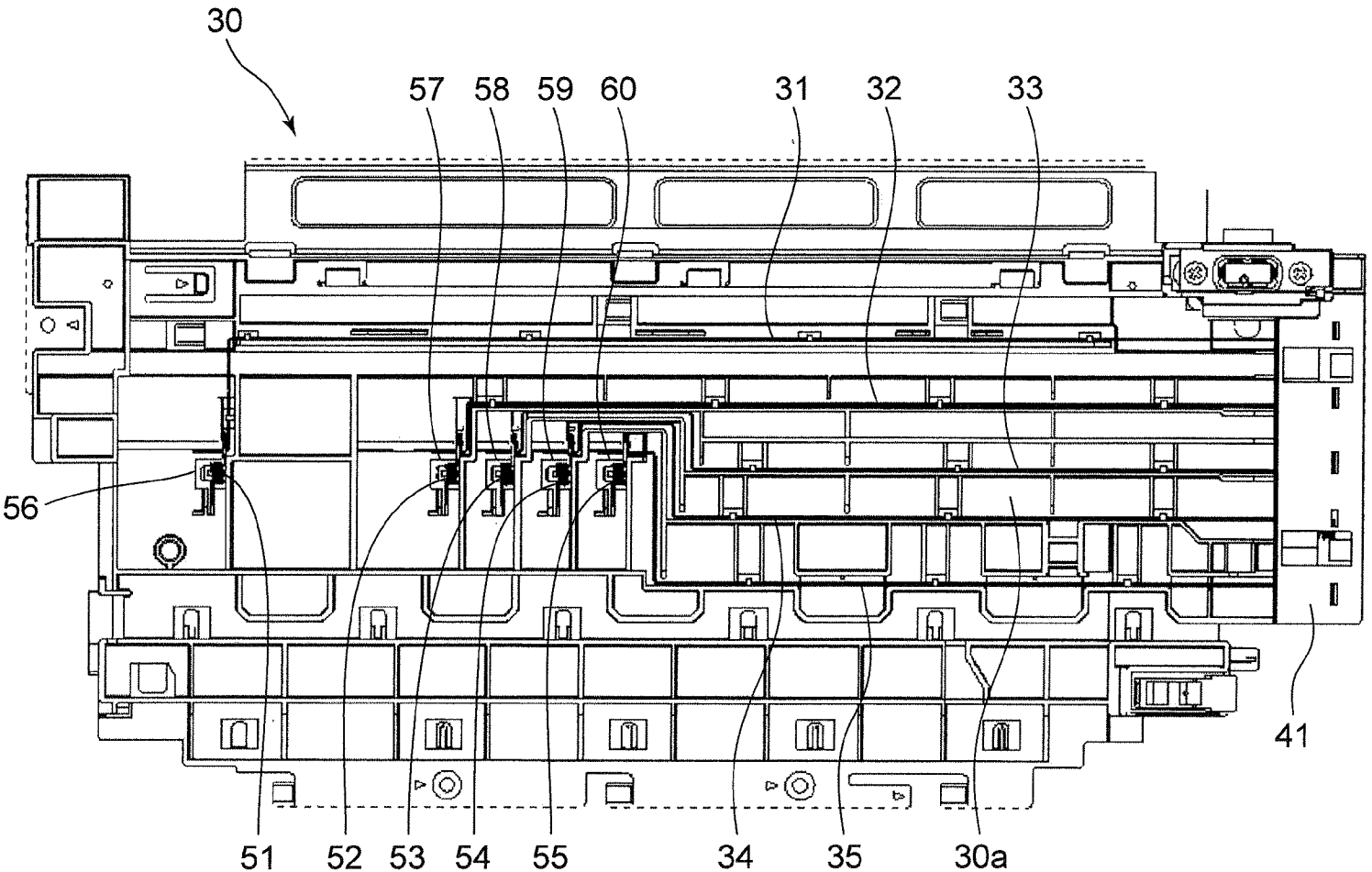
FIG. 6 is a front view of the wire holding plate.
Figure 7:
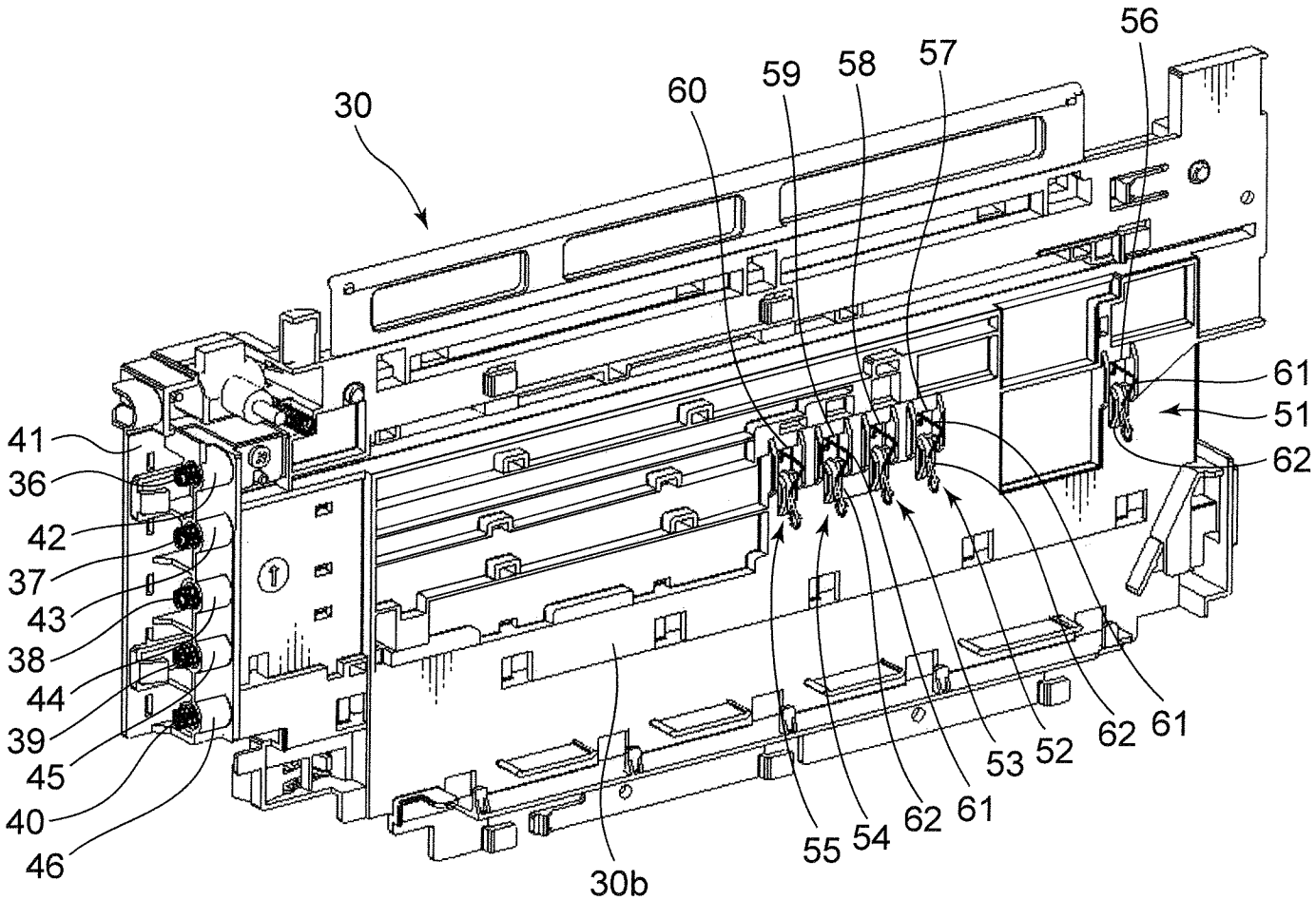
FIG. 7 is a perspective view of a wire holding plate as seen from the rear.

FIG. 5 is a perspective view of the wire holding plate 30 as seen from the front thereof, FIG. 6 is a front view of the wire holding plate 30, and FIG. 7 is a perspective view of the wire holding plate 30 as seen from the rear thereof. The wire holding plate 30 holds wires 31, 32, 33, 34, and 35 which electrically connect the high-voltage board 28 with the processing units and which supply a high voltage to the processing units. The wire holding plate 30 is molded from an insulating resin and is therefore a member that is lighter than the sheet-metal frame.

The wire holding plate 30 is a rectangular plate-like member that extends over approximately the entire dimension of the upper coupling piece 24 and the lower coupling piece 25 in an extending direction (front-rear direction). In other words, a longitudinal dimension of the wire holding plate 30 is approximately equal to a longitudinal dimension of the upper coupling piece 24 and the lower coupling piece 25. In addition, a dimension of the wire holding plate 30 in an up-down direction is set such that the wire holding plate 30 bridges the upper coupling piece 24 and the lower coupling piece 25. Therefore, the wire holding plate 30 is attached to the upper coupling piece 24 and the lower coupling piece 25 in a mode in which the space between the upper coupling piece 24 and the lower coupling piece 25 is blocked by the wire holding plate 30.

The wire holding plate 30 has a surface which faces outward in a state where the wire holding plate 30 is fixed to the upper coupling piece 24 and the lower coupling piece 25 and which is assumed to be a routing surface 30*a* for routing the wires 31 to 35. In the example shown in FIGS. 5 and 6, five wires 31 to 35 are used. Each of the wires 31 to 35 extends in a predetermined direction on the routing surface 30*a*. The wires 31 to 35 are made of a flexible metal wire and respectively have first contacts 36, 37, 38, 39, and 40 at one of the ends and second contacts 51, 52, 53, 54, and 55 at other ends. In other words, the wire 31 has a first contact 36 and a second contact 51, the wire 32 has a first contact 37 and a second contact 52, the wire 33 has a first contact 38 and a second contact 53, the wire 34 has a first contact 39 and a second contact 54, and the wire 35 has a first contact 40 and a second contact 55. Each of the wires 31 to 35 is held in an insulated state with respect to the first sheet-metal frame 21, the second sheet-metal frame 22, and the like by the routing surface 30*a* of the wire holding plate 30. In addition, the respective wires 31 to 35 are insulated from each other by being routed spaced apart from each other on the routing surface 30*a*.

The first contacts 36 to 40 are contacts capable of coming into contact with respective terminals provided on the high-voltage board 28 and are one of the ends of the wires 31 to 35 which have been formed into a coil shape. The wire holding plate 30 has a contact holding section 41 for holding the first contacts 36 to 40 at an end on the side of the first sheet-metal frame 21. The contact holding section 41 has five bosses 42, 43, 44, 45, and 46 which are aligned in an up-down direction. The first contacts 36 to 40 of the wires 31 to 35 are held at predetermined positions by being fitted into corresponding bosses 42 to 46.

Each of the second contacts 51 to 55 are contacts capable of coming into contact with respective terminals 130, 131, 132, 133, and 134 (FIG. 8) provided on the intermediate transfer unit 3, and has a dogleg curved contact section 61. The wire holding plate 30 has window sections 56, 57, 58, 59, and 60 which are formed at predetermined positions. The aforementioned coil part is held by a contact holding section 62 provided in a vicinity of the window parts 56 to 60 on the wire holding plate 30. The curved contact section 61 protrudes toward the side of a rear surface 30*b* of the wire holding plate 30 in a state where the aforementioned coil part is held by the contact holding section 62. When the intermediate transfer unit 3 is mounted inside the housing 11 as will be described later, the curved contact section 61 elastically deforms and comes into contact with contacts of the respective terminals 130 to 134 of the intermediate transfer unit 3.

Figure 8:
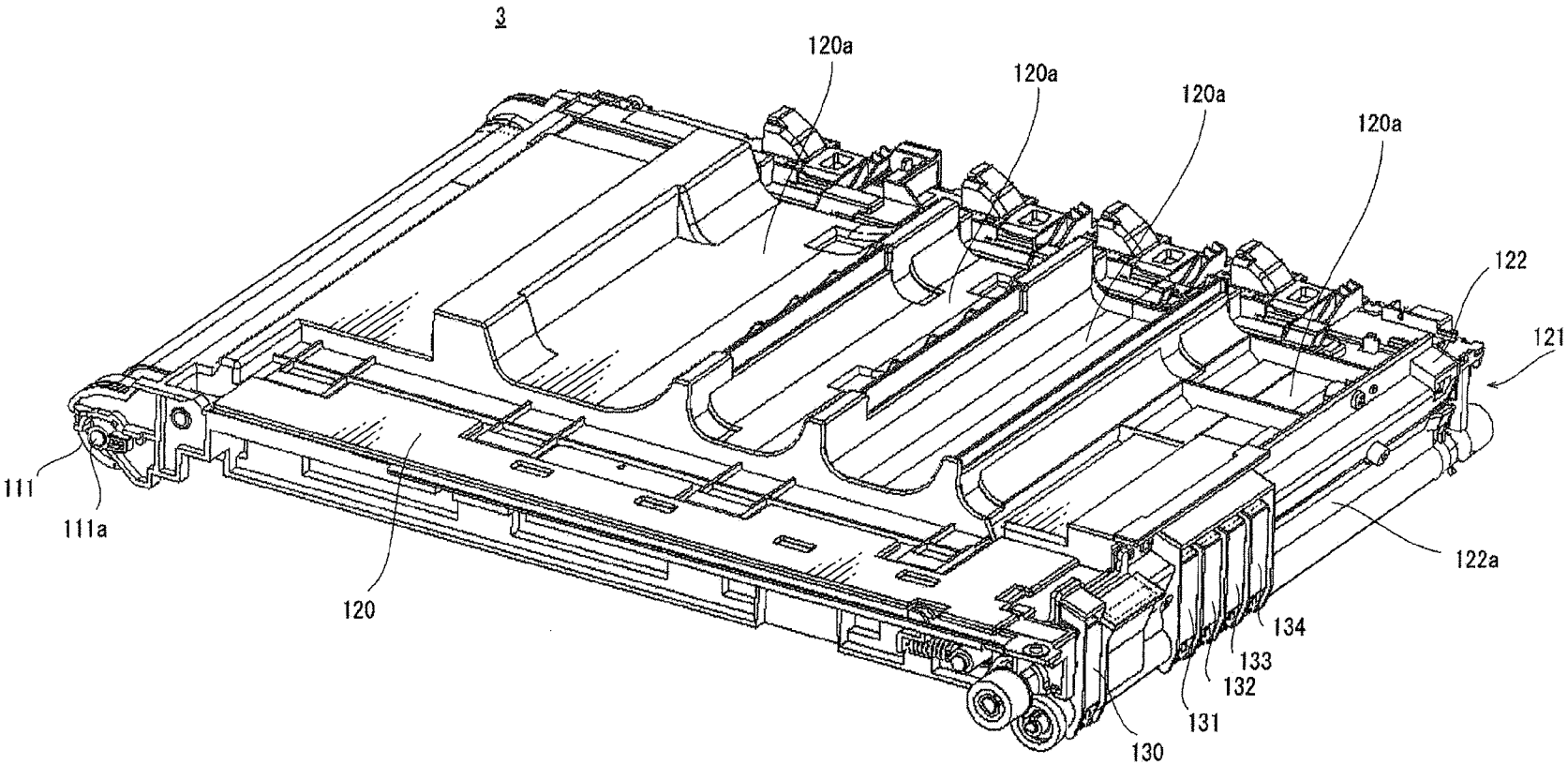
FIG. 8 is an external perspective view of an intermediate transfer unit.
Figure 9:
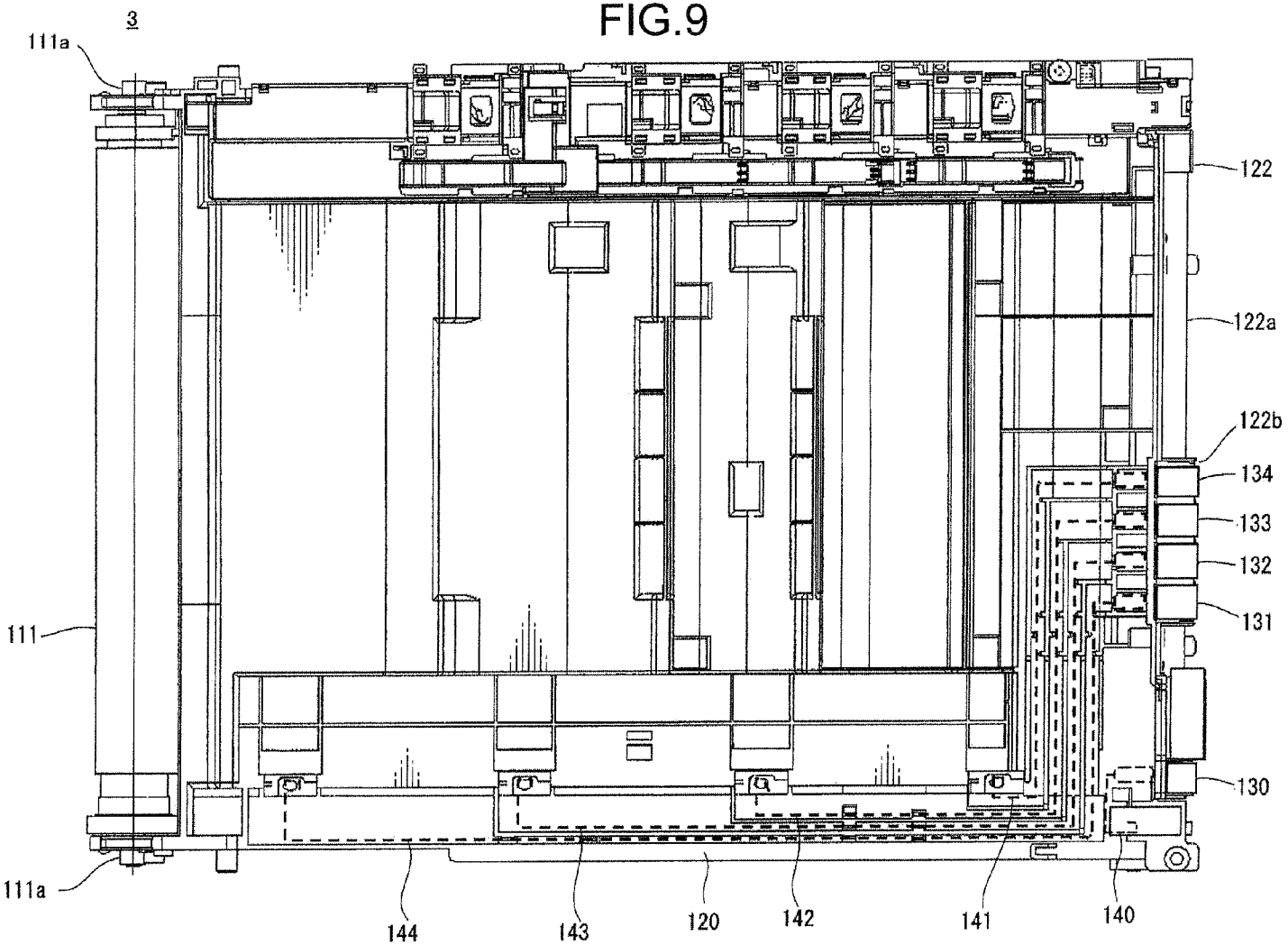
FIG. 9 is a plan view of the intermediate transfer unit.
Figure 10:
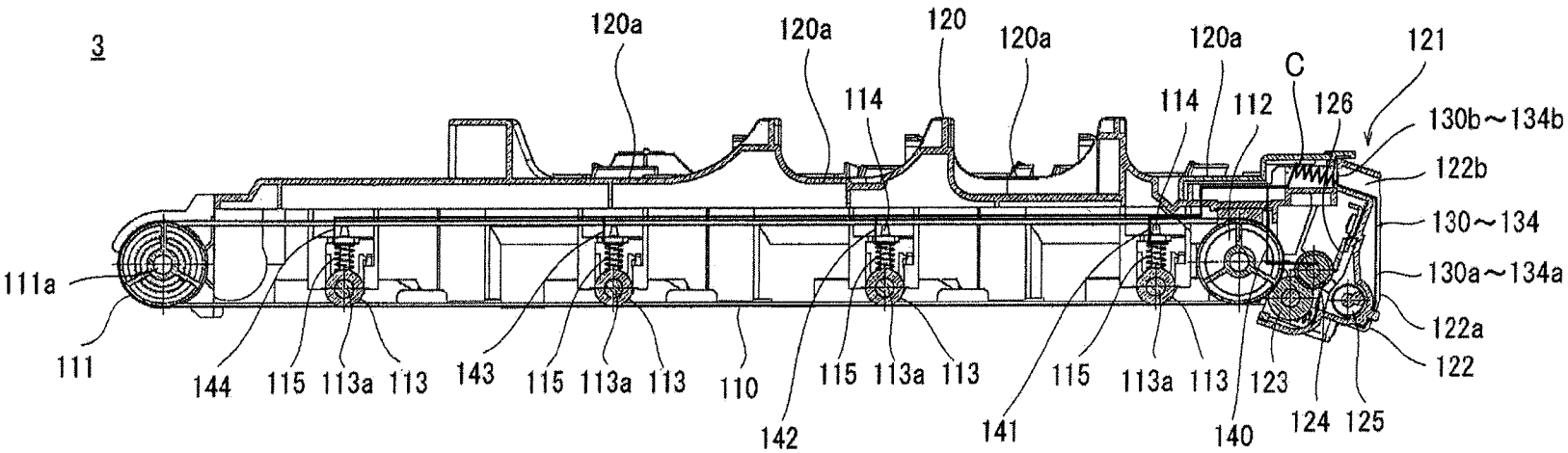
FIG. 10 is a side view of the intermediate transfer unit.

Next, a configuration of the intermediate transfer unit 3 will be described with reference to FIGS. 8 to 10. FIGS. 8, 9, and 10 are, respectively, an external perspective view, a plan view, and a side view of the intermediate transfer unit 3. The intermediate transfer unit 3 is formed by an insulating resin material and includes a hollow belt housing 120 whose bottom surface is opened. The belt housing 120 rotatably holds the driving roller 111, the driven roller 112, and the primary transfer roller 113. A plurality of container mounting sections 120*a* are provided on an upper surface of the belt housing 120. A toner container 104 (FIG. 2) of each color is mounted on each of the container mounting sections 120*a*.

An endless transfer belt 110 is bridged across the driving roller 111 and the driven roller 112. The primary transfer roller 113 is in contact with a rear surface of the transfer belt 110 in a state where the primary transfer roller 113 is biased downward. In other words, both ends of a shaft member 113*a* that rotates the primary transfer roller 113 around a shaft is rotatably held by a conductive shaft bearing member 114. The shaft bearing member 114 is supported so as to be movable in an up-down direction by the belt housing 120 and is biased downward by a compression coil spring 115. In order to transfer toner images of respective colors formed on the respective photosensitive drums 101 onto the transfer belt 110, a transfer bias whose polarity is opposite to a charging polarity of the toners is applied to the primary transfer roller 113 through the shaft bearing member 114.

The belt cleaning device 121 is attached to the belt housing 120 at a position which is on a front side of the transfer belt 110 and which opposes the driven roller 112. The belt cleaning device 121 is formed by an insulating resin material and includes a cleaning housing 122 that is opened on a side opposing the driven roller 112. The cleaning housing 122 rotatably supports a brush roller 123, a collecting roller 124, and a conveying spiral 125. The brush roller 123 is structured such that brush bristles are implanted on a circumferential surface of a rotary shaft. The brush bristles slidingly contact a surface of the transfer belt 110 while being rotated and collects residual toner by electrostatically adsorbing or scraping off the residual toner. The collecting roller 124 is a metallic roller that is provided so as to rotate while contacting a surface of the brush roller 123. A cleaning bias whose polarity is opposite to a charging polarity of the toners is applied to the collecting roller 124. The collecting roller 124 collects toner attached to the brush bristles of the brush roller 123 by electrostatically adsorbing the toner onto a circumferential surface of the collecting roller 124. A blade 126 is provided abutting the circumferential surface of the collecting roller 124, and collected toner attached to the surface of the collecting roller 124 is scraped off by the blade 126. The conveying spiral 125 has a spiral shape along an axial direction thereof, and conveys the collected toner scraped off by the blade 126 in the axial direction and delivers the collected toner to a collecting tank (not shown) provided on the side of one end in the axial direction.

Next, supplying of a bias voltage to the primary transfer roller 113 and the collecting roller 124 will be described. As shown in FIGS. 8 to 10, five terminals 130, 131, 132, 133, and 134 formed by a metallic plate-like member are attached to an external wall 122*a* of the cleaning housing 122. A cleaning bias is supplied from the terminal 130 to the collecting roller 124, and transfer biases are respectively supplied from the terminals 131 to 134 to the primary transfer roller 113. Housing spaces 122*b* are respectively formed in correspondence to the respective terminals 130 to 134 on the external wall 122*a*. The respective terminals 130 to 134 are housed insulated from each other in the respective housing spaces 122*b*. The respective terminals 130 to 134 have band-shaped planar sections 130*a* to 134*a* which extend in an up-down direction in a state where the respective terminals 130 to 134 are housed in the respective housing spaces 122*b*. Upper parts of the planar sections 130*a* to 134*a* are bent toward the side of the opening of the cleaning housing 122, and ends of the upper parts are further bent upward to constitute contact surfaces 130*b* to 134*b*.

Meanwhile, junction lines 140, 141, 142, 143, and 144 are provided on the belt housing 120 in correspondence to the respective terminals 130 to 134. The junction lines 140 to 144 are formed by an elastic metal wire and are housed along a wiring groove formed defined by a rib on the belt housing 120. Coil-shaped sections C are formed on one of the ends of the junction lines 140 to 144. The respective coil-shaped sections C are in contact with, and in conduction with, the contact surfaces 130*b* to 134*b* of the terminals 130 to 134. Another end of the junction line 140 is extended to a shaft bearing member (not shown) on one end of the collecting roller 124 and abuts, and is in conduction with, the shaft bearing member. In addition, other ends of the junction lines 141 to 144 are extended to compression coil springs 115 that bias shaft bearing members 114 on the one ends of respectively corresponding primary transfer rollers 113 and are in conduction with the respective compression coil springs 115.

Next, an attachment/detachment configuration of the intermediate transfer unit 3 to the housing 11 and conduction between the second contacts 51 to 55 and the terminals 130 to 134 will be described. As shown in FIG. 2, in the housing space S inside the housing 11, the intermediate transfer unit 3 is housed in a horizontal state with axes of the driving roller 111 and the driven roller 112 extending in a front-rear direction. Toner containers 104 are respectively mounted on the container mounting sections 120*a* on the upper surface of the intermediate transfer unit 3. The sheet discharge surface 161 provided on the upper surface of the housing 11 is supported so as to be openable and closeable upward with an end on the side of the right side cover 15 as a point of support. By opening the sheet discharge surface 161 upward, an upper part of the housing space S inside the housing 11 is opened. The respective toner containers 104 can be attached and detached from the opening. Furthermore, in a state where the respective toner containers 104 have been removed from the opening, the intermediate transfer unit 3 can be attached and detached from the opening.

Positioning sections (not shown) which position and support both ends of a rotary shaft 111*a* of the driving roller 111 supported by the intermediate transfer unit 3 are respectively formed on the first sheet-metal frame 21 and the second sheet-metal frame 22 of the housing 11. The intermediate transfer unit 3 is inserted from the opening created by opening the sheet discharge surface 161 in an inclined state caused by holding the side where the driven roller 112 is provided upward, and is positioned by inserting both ends of the rotary shaft 111*a* of the driving roller 111 into the positioning sections of the first sheet-metal frame 21 and the second sheet-metal frame 22. Subsequently, the intermediate transfer unit 3 is rotationally moved around the rotary shaft 111*a* so that the side of the driven roller 112 reaches a horizontal position. Regulating sections (not shown) which regulate the side of the driven roller 112 of the intermediate transfer unit 3 from moving further downward from the horizontal position are respectively provided on the first sheet-metal frame 21 and the second sheet-metal frame 22. Accordingly, the intermediate transfer unit 3 is positioned by its own weight to a horizontal state with respect to the housing 11.

In addition, in the mounting operation of the intermediate transfer unit 3 described above, when rotationally moving the intermediate transfer unit 3 around the rotary shaft 111*a* of the driving roller 111 to a horizontal state, the planar sections 130*a* to 134*a* of the respective terminals 130 to 134 come into sliding contact with the curved contact section 61 of the second contacts 51 to 55. In doing so, the curved contact section 61 elastically deforms. Subsequently, after the intermediate transfer unit 3 has reached a horizontal state, the contact between the planar sections 130*a* to 134*a* of the respective terminals 130 to 134 and the curved contact section 61 of the second contacts 51 to 55 is maintained.

In addition, the intermediate transfer unit 3 is removed from the housing 11 in a reverse procedure to the procedure described above. In other words, the intermediate transfer unit 3 is removed from the opening at the upper part of the housing space S in an inclined state caused by rotationally moving the side of the driven roller 112 upward.

Figure 11:
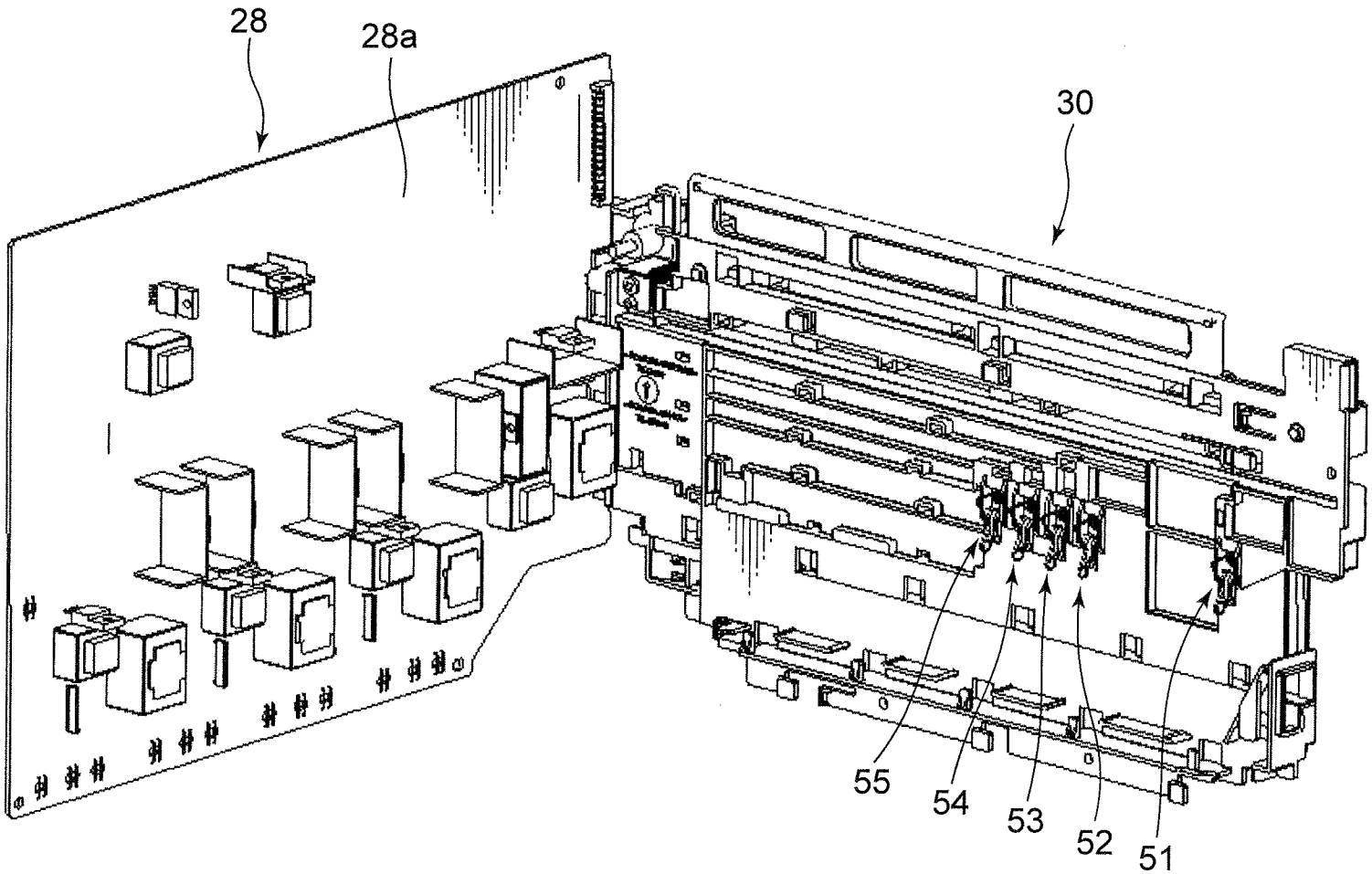
FIG. 11 is a perspective view of the wire holding plate and a high-voltage board in a state where a wire and the high-voltage board are electrically connected.
Figure 12:
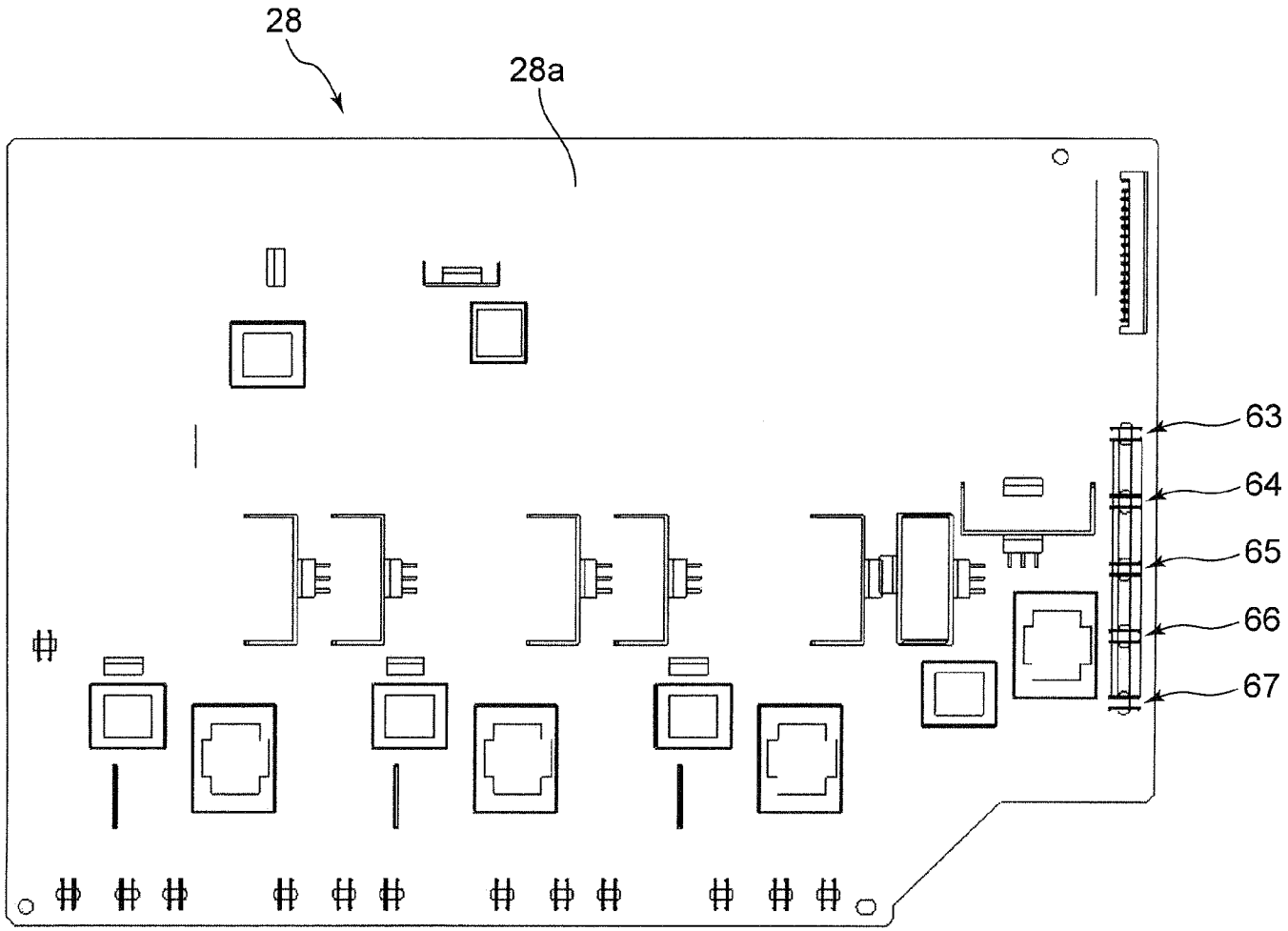
FIG. 12 is a plan view of the high-voltage board as seen from the rear.

FIG. 11 is a perspective view of the wire holding plate 30 and the high-voltage board 28 in a state where wires 31 to 35 and the high-voltage board 28 are electrically connected, and FIG. 12 is a plan view of the high-voltage board 28 as seen from the rear thereof.

The high-voltage board 28 has a mounting surface 28*a* on which various electronic devices and the like are mounted. The mounting surface 28*a* is a surface which faces the first sheet-metal frame 21 in a state where the high-voltage board 28 is fixed to the first sheet-metal frame 21. Note that the first sheet-metal frame 21 has been omitted in FIG. 11. Board-side contacts 63, 64, 65, 66, and 67 made of jumper leads soldered to the mounting surface 28*a* are provided on the mounting surface 28*a* in correspondence with the first contacts 36 to 40 of the wires 31 to 35. The first contacts 36 to 40 come into contact with the board-side contacts 63 to 67 in an elastically compressed state.

Next, once again referring to FIG. 5, a rib 70 protrudingly provided on the routing surface 30*a* of the wire holding plate 30 will be described. The rib 70 is formed over approximately the entire longitudinal dimension of the wire holding plate 30 and is made up of a large number of rib pieces which extend in up-down and front-rear directions in FIG. 5.

A part of the rib pieces extends along an extending direction of the wires 31 to 35. For example, a rib piece 71 extends in an extending direction of the wire 33 between the wire 33 (first wire) and the wire 34 (second wire) which are adjacent to each other. The wire 33 is routed between a surface approximately orthogonal to the routing surface 30*a* and the routing surface 30*a* on the rib piece 71. The rib piece 72 extends in an extending direction of the wire 34 between the wires 34 and 35 which are adjacent to each other, and the wire 34 is routed between a surface approximately orthogonal to the routing surface 30*a* and the routing surface 30*a* on the rib piece 72. In this manner, the rib piece 71 extends so as to separate the wire 33 from the wire 34. Similarly, the rib piece 72 extends so as to separate the wire 34 from the wire 35.

With the image forming device 10 according to the present embodiment described above, the wire holding plate 30 is fixed to the upper coupling piece 24 and the lower coupling piece 25 over approximately the entire dimension in the extending direction of the upper coupling piece 24 and the lower coupling piece 25. Therefore, the pair of the first sheet-metal frame 21 and the second sheet-metal frame 22 which is coupled by the upper coupling piece 24 and the lower coupling piece 25 can suppress torsion attributable to a load of supporting the processing units. Accordingly, rigidity of the housing 11 can be secured.

In addition, since the rigidity of the housing 11 is secured using the wire holding plate 30, usage of sheet metal that is used as coupling pieces can be reduced. Particularly, in the embodiment described above, the upper coupling piece 24 and the lower coupling piece 25 which are separated from each other are used as coupling pieces to be attached to left edges of the first sheet-metal frame 21 and the second sheet-metal frame 22, and the wire holding plate 30 is attached to the upper coupling piece 24 and the lower coupling piece 25 so as to block the space between the upper coupling piece 24 and the lower coupling piece 25. Accordingly, the weight of the image forming device 10 can be reduced. As shown, the image forming device 10 according to the present embodiment uses the wire holding plate 30 to secure rigidity of the housing 11 and to reduce the weight of the image forming device 10.

Particularly, in the present embodiment, instead of having each of the wires 31 to 35 be supported by mutually-independent wire holding members such as resin cases which extend along a routing direction of the wires 31 to 35, all of the wires 31 to 35 are supported by a single resin plate-like member (the wire holding plate 30) configured so as to extend over approximately the entire dimension of the upper coupling piece 24 and the lower coupling piece 25 in an extending direction. Therefore, the rigidity of the housing 11 can be readily secured and an increase in the number of parts can be suppressed.

In addition, with the image forming device 10 according to the present embodiment, since the wire holding plate 30 is made of resin, the weight of the image forming device 10 can be further reduced. Furthermore, the wires 31 to 35 can be insulated from the upper coupling piece 24 and the lower coupling piece 25 which are made of sheet metal.

Moreover, with the image forming device 10 according to the present embodiment, since the wire holding plate 30 has a rib 70 protrudingly provided on the routing surface 30*a*, rigidity of the wire holding plate 30 and, in turn, rigidity of the housing 11 can be further achieved.

In addition, with the image forming device 10 according to the present embodiment, for example, since the wire 33 is separated from the wire 34 by the rib piece 71, a favorable insulation performance between the wire 33 and the wire 34 can be achieved.

Moreover, the specific embodiment described above primarily includes an invention configured as follows.

An image forming device according to an aspect of the present invention includes: a processing unit which performs an image forming process on a sheet; a housing which defines a housing space that houses the processing unit, and which includes a pair of a first sheet-metal frame and a second sheet-metal frame that oppose each other and a sheet-metal coupling piece extending between the first sheet-metal frame and the second sheet-metal frame and coupling the first sheet-metal frame and the second sheet-metal frame to each other, with the first sheet-metal frame and the second sheet-metal frame being configured to support the processing unit therebetween; a high-voltage board which generates a high voltage to be supplied to the processing unit; a wire which electrically connects the high-voltage board and the processing unit with each other and which supplies the high voltage to the processing unit; and a wire holding plate which holds the wire, and which extends over substantially the entire dimension of the coupling piece in an extending direction thereof and is fixed to the coupling piece.

According to this configuration, since a wire holding plate is fixed to a coupling piece over approximately the entire dimension of the coupling piece in an extending direction, torsion attributable to a load of supporting the processing unit can be suppressed by a pair of a first sheet-metal frame and a second sheet-metal frame coupled by the coupling piece. Accordingly, rigidity of the housing can be secured. In addition, since the rigidity of the housing is secured by using the wire holding plate, usage of sheet metal for the coupling piece can be reduced. As a result, the weight of the image forming device can be reduced.

In a preferred embodiment of the present invention, the wire holding plate is made of resin. According to this configuration, the weight of the image forming device can be further reduced. In addition, a wire can be insulated from a sheet-metal coupling piece.

In another preferred embodiment of the present invention, the wire holding plate has a routing surface on which the wire is routed and a rib which is protrudingly provided on the routing surface and which reinforces the wire holding plate. According to this configuration, since a rib is provided on a routing surface of the wire holding plate, rigidity of the wire holding plate and, in turn, rigidity of the housing can be further achieved.

In yet another preferred embodiment of the present invention, the wire includes a first wire and a second wire routed along the first wire, and the rib extends along the first wire and the second wire between the first wire and the second wire.

According to this configuration, since the first wire and the second wire are separated from each other by a rib, a favorable insulation performance between the first wire and the second wire can be achieved.

In still another preferred embodiment of the present invention, the coupling piece includes a first coupling piece which couples upper parts of edges on one side of the first sheet-metal frame and the second sheet-metal frame with each other and a second coupling piece which is separated from the first coupling piece by a predetermined distance, and which is positioned below the first coupling piece, and moreover which couples middle parts of the edges on one side with each other, wherein the wire holding plate has a dimension in an up-down direction which bridges the first coupling piece and the second coupling piece and is attached to the first coupling piece and the second coupling piece.

According to this configuration, by forming the coupling piece with a first coupling piece and a second coupling piece which are separated from each other in an up-down direction, usage of a sheet-metal frame can be further suppressed and the weight of the image forming device can be further reduced.

In particular, a mode is desirably adopted in which the wire holding member is a rectangular plate-like member and blocks a space between the first coupling piece and the second coupling piece. According to this configuration, sufficient rigidity can be secured even when a mode is adopted in which coupling pieces are separated from each other in an up-down direction.

This application is based on Japanese Patent application No. 2010-129913 filed in Japan Patent Office on Jun. 7, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming device, comprising:

a processing unit which performs an image forming process on a sheet;

a housing defining a housing space that houses the processing unit, the housing including a first sheet-metal frame and a second sheet-metal frame that oppose each other and a sheet-metal coupling piece extending between the first sheet-metal frame and the second sheet-metal frame and coupling the first sheet-metal frame and the second sheet-metal frame to each other, with the first sheet-metal frame and the second sheet-metal frame being configured to support the processing unit therebetween;

a high-voltage board which generates a high voltage to be supplied to the processing unit;

first wires electrically connecting the high-voltage board and the processing unit with each other and supplying the high voltage to the processing unit; and a wire holding plate holding the first wires, and extending substantially entirely across the coupling piece in an extending direction thereof and being fixed to the coupling piece, wherein each of the first wires has a contact section that protrudes from the wire holding plate toward the housing space, the processing unit is configured to be attached to the housing space from above the housing and includes:

a belt housing;

first and second rollers that are rotatably held by the belt housing and arranged parallel to the coupling piece;

a transfer belt bridged across the first and second rollers;

a plurality of transfer rollers rotatably held by the belt housing between the first roller and the second roller;

terminals arranged at a side edge of the belt housing along the second roller and being in contact respectively with the contact sections of the first wires; and second wires that electrically connect the terminals respectively to the transfer rollers.

2. The image forming device according to claim 1, wherein the wire holding plate is made of resin.

3. The image forming device according to claim 1, wherein the wire holding plate has a routing surface on which the wire is routed and a rib protruding on the routing surface and reinforcing the wire holding plate.

4. The image forming device according to claim 3, wherein the rib extends between the first wires.

5. The image forming device according to claim 1, wherein the coupling piece includes a first coupling piece that couples upper parts of edges on one side of the first sheet-metal frame and the second sheet-metal frame with each other and a second coupling piece separated from the first coupling piece by a predetermined distance and positioned below the first coupling piece, and the second coupling piece couples middle parts of the edges on one side with each other, and the wire holding plate has a dimension in an up-down direction which bridges the first coupling piece and the second coupling piece, and is attached to the first coupling piece and the second coupling piece.

6. The image forming device according to claim 5, wherein the wire holding plate is a rectangular plate-like member and blocks a space between the first coupling piece and the second coupling piece.

7. The image forming device according to claim 1, further comprising:

a first positioning section formed on the first sheet-metal frame and the second sheet-metal frame, the first positioning section positioning and supporting both ends of the first roller; and a second positioning section formed on the first sheet-metal frame and the second sheet-metal frame, the second positioning section positioning and supporting both ends of the second roller;

wherein after the processing unit is inserted into the housing space from above in an inclined state caused by upward holding the side where the second roller is provided, the first roller is positioned and supported by the first positioning section, and the processing unit is rotationally moved around the side where the first roller is provided and the side of the second roller reaches a horizontal position against the first roller so that the second roller is positioned and supported by the second positioning section and the plurality of terminals comes into contact with the plurality of contact sections.

8. The image forming device of claim 1 wherein the terminals of the processing unit are configured to slide into electrical contact with the contact sections of the first wires as the processing unit is mounted into the housing space.

* * * * *